US008944066B1

(12) United States Patent
Kamau et al.

(10) Patent No.: US 8,944,066 B1
(45) Date of Patent: Feb. 3, 2015

(54) DEVICES AND METHODS FOR RESTRICTING PRESSURE APPLICATION TO INJURED TISSUE

(71) Applicant: Curve Cure LLC, San Francisco, CA (US)

(72) Inventors: Vanessa Kamau, San Francisco, CA (US); Ekechi Nwokah, San Francisco, CA (US)

(73) Assignee: Curve Cure LLC, San Francisco, CA (US)

( * ) Notice: Subject to any disclaimer, the term of this patent is extended or adjusted under 35 U.S.C. 154(b) by 0 days.

(21) Appl. No.: 14/092,667

(22) Filed: Nov. 27, 2013

(51) Int. Cl.
*A61G 15/00* (2006.01)
*A61G 13/12* (2006.01)

(52) U.S. Cl.
CPC ..... *A61G 13/123* (2013.01)
USPC ..... 128/845

(58) Field of Classification Search
CPC ..... A61F 5/00; A61F 5/01; A61F 5/05816; A61F 5/30; A61F 5/34; A61F 13/069; A47C 1/00; A47C 4/54; A47C 27/08; A47C 27/081
USPC ..... 128/845; 602/13; 5/706
See application file for complete search history.

(56) References Cited

U.S. PATENT DOCUMENTS

| | | | | |
|---|---|---|---|---|
| 602,486 | A | 4/1898 | Szkulezewski et al. | |
| 2,623,574 | A | 12/1952 | Damsch | |
| 3,253,861 | A * | 5/1966 | Howard | 297/452.43 |
| 3,419,309 | A * | 12/1968 | Smith | 297/452.41 |
| 3,672,720 | A * | 6/1972 | Wilson | 297/118 |
| 4,021,872 | A | 5/1977 | Powell | |
| 4,601,667 | A * | 7/1986 | Hull | 441/131 |
| 4,617,690 | A | 10/1986 | Grebe | |
| 4,724,558 | A * | 2/1988 | Reiff | 5/417 |
| 4,781,413 | A * | 11/1988 | Shumack, Jr. | 297/252 |
| 4,826,249 | A | 5/1989 | Bradbury | |
| 4,905,332 | A | 3/1990 | Wang | |
| 5,384,923 | A * | 1/1995 | Hwang et al. | 5/419 |
| 5,412,824 | A | 5/1995 | Emerson et al. | |
| 5,522,103 | A * | 6/1996 | Kier et al. | 5/630 |
| 5,603,690 | A * | 2/1997 | Barry | 601/148 |
| 5,679,040 | A | 10/1997 | Bianchi-Holm | |

(Continued)

FOREIGN PATENT DOCUMENTS

| | | |
|---|---|---|
| GB | 2471467 | 1/2011 |

*Primary Examiner* — Patricia Bianco
*Assistant Examiner* — Raymond E Harris
(74) *Attorney, Agent, or Firm* — Foley & Lardner LLP

(57) ABSTRACT

A support device for improving the post-operative recovery experience is provided herein. Methods of using and making such a support device are also disclosed. In various embodiments, the support device and related methods provide physical support to a post-operative patient through targeted distribution of the patient's weight. The device is expandable and/or deformable between a fully-deployed state and a collapsed, partially collapsed, and/or deformed state. In the fully-deployed state, the device is shaped to form a physical barrier that restricts the application of pressure on healing tissue. Such a device is configured to limit undesired post-operative reconfiguration of a healing tissue. The support device of some embodiments is in the form of a support pillow, cushion, seat, mattress, or mattress pad containing a deformity. In some embodiments, the device is patient-specific, molded to have a fully-deployed size and shape which conforms to the expected reconfigured dimensions of a particular patient.

4 Claims, 10 Drawing Sheets

(56) References Cited

U.S. PATENT DOCUMENTS

| | | | | |
|---|---|---|---|---|
| 5,890,246 | A | 4/1999 | Davis | |
| 5,930,152 | A * | 7/1999 | Dumont et al. | 700/302 |
| 6,042,186 | A * | 3/2000 | Kojic et al. | 297/452.41 |
| 6,233,768 | B1 | 5/2001 | Harding | |
| 6,959,464 | B2 | 11/2005 | Fahey | |
| 7,127,764 | B1 | 10/2006 | Harding et al. | |
| 7,266,852 | B2 | 9/2007 | Davis | |
| 7,604,606 | B2 * | 10/2009 | Dehli | 601/46 |
| 8,303,361 | B2 | 11/2012 | Green | |
| 2006/0162081 | A1 | 7/2006 | Kerekes et al. | |
| 2006/0163935 | A1 * | 7/2006 | Harris | 297/452.41 |
| 2011/0263950 | A1 * | 10/2011 | Larson et al. | 600/301 |

* cited by examiner

DEVICES AND METHODS FOR RESTRICTING PRESSURE APPLICATION TO INJURED TISSUE

FIELD OF THE INVENTION

The present invention relates generally to the field of medical equipment and specifically to support structures for use during surgery or post-operative or post-trauma recovery.

BACKGROUND

During and after various surgical procedures and while recovering from injury, pressure application must be limited at the injured and/or surgical site. It is often inconvenient and difficult to limit the application of pressure. This is particularly true following cosmetic enhancement surgeries, such as, for example, body mass augmentations such as buttocks augmentation, breast enhancement, breast reconstruction, and facial reconstruction.

Body mass augmentation such as buttocks augmentation is a procedure of growing popularity. Whether a result of rapid and substantial weight loss following, for example, bariatric surgery, or due to genetics or increasing age, many individuals are unhappy with the firmness and shape of bodily features such as their buttocks. A body's fat, muscles, and other soft tissues can diminish following dramatic weight loss or during the aging process, affecting the body's appearance. For example, the body's buttocks may flatten, spread, and/or sag. Such characteristics are treated during buttocks augmentation through insertion of an implant, such as a silicone implant, or injection of autologous fat into the desired area. In procedures utilizing autologous fat, an individual's fat is removed from a location of accumulated fat, such as from the abdomen, thighs, arms, back, or above the hips via a syringe or liposuction techniques; the fat is then processed and injected into the desired area of augmentation.

Following such a procedure, there is a significant risk that application of pressure on or about the area of enhancement will lead to reconfiguration of the implanted mass, leading to a cosmetically unacceptable result. Accordingly, the patient is advised to avoid applying pressure onto the area of enhancement for at least three weeks. Some patients may be instructed to avoid such pressure application for as many as three months or more. Currently, little exists to help patients comply with these instructions. During this recovery time, back sleepers may have to sleep on their stomach or sides. Patients are often cautioned to avoid sitting altogether.

If a patient does not adhere to these instructions, the consequences can be severe. As noted above, if sufficient pressure is applied to an augmented site for a long enough period, a displacement of the injected fat will occur, leading to flattening or other undesirable reshaping of the augmented area. Additionally, prolonged pressure application is believed to increase a body's reabsorption of the injected fat, thus reducing the effectiveness of the procedure and the size of a patient's augmented body part.

SUMMARY

A need exists for devices and methods that improve the post-operative recovery experience. In particular, a need exists for devices and methods that allow patients to continue with normal day-to-day activities while recovering from surgery, for example, to the breasts, face, hips, buttocks, or surrounding region. A need also exists for devices and methods that allow patients to lie down comfortably as they recover from such surgeries. A need also exists for devices and methods for use during surgery, which can limit pressure applied to a surgical site in circumstances where a patient must be positioned to rest on a body portion on or near the surgical site, for example, when a surgery involves multiple surgical sites. Various embodiments disclosed herein may fulfill one or more of these needs.

One aspect of the present disclosure relates to a support device for limiting reconfiguration of a tissue that has been recently placed and shaped into a portion of a patient's body. The support device comports to a particular shape, such as a chair, a mattress, or a seat cushion, and contains a deformity placed in a manner to minimize or eliminate pressure on the reconfigured body mass. The deformity may comprise a cavity, a depression, or a material of significantly less stiffness such that the area adjacent to, but removed from, the deformity absorbs most of the pressure, thereby leaving little pressure on the reconfigured body mass. In some embodiments, the placement of the cavity is fixed within the support device. In other embodiments, the location of the cavity is moveable based on the location of the reconfigured body mass. In some embodiments, the support device is sized and styled such that there is little or no visible evidence to a third party that a support device is being used.

In various embodiments, the device includes at least a portion that is expandable. When expanded, such a device is shaped to include a deformity that limits the application of pressure onto said tissue. In some embodiments, the deformity in the expanded device is defined by walls, which form a physical barrier that restricts pressure sufficient to cause undesired reconfiguration of said tissue from being applied onto said tissue.

In some embodiments, the support device limits reconfiguration of fat tissue that has been recently placed and shaped into a patient's buttocks, hips, thighs, breasts, arms, or cheeks.

The device of some embodiments is reversibly expandable. Such a device permits repeated uses. In some embodiments, the device is portable and configured to be positioned on or under a patient as needed. In some embodiments, the device is configured to contact one or more areas of a patient around the reshaped or augmented body portion while minimizing or eliminating pressure on the reshaped or augmented body portion.

In some embodiments, the device is a support structure, such as a chair, a mattress, a mattress pad, a pillow, or a cushion. In each case, the support structure is deformed in at least that area where the reshaped or augmented body portion will be located. For example, in some embodiments, the device includes a seat cushion formed of a first expandable wall and a back cushion formed of a second expandable wall. Upon expansion, such a device achieves a pre-defined shape in which the seat cushion is coupled to the back cushion at an angle. The angle of the back cushion relative to the seat cushion may be, for example, 80 to 180 degrees. In the expanded, pre-defined shape, the first expandable wall and second expandable wall together form the physical barrier, defining, at least in part, a deformity such as a cavity sized and shaped to receive at least a portion of a patient's seated buttocks. In some such embodiments, the back cushion is permanently coupled to the seat cushion by a plurality of posts. In some embodiments, an interior region of the back cushion, seat cushion, and plurality of posts are in fluid communication. In some embodiments, the back cushion, seat cushion, and plurality of posts are inflatable and deflatable as a single unit. As another example, in some embodiments, the device is in the form of a mattress or mattress cushion and is formed of one or more expandable mattress walls. A portion of the mattress wall(s) define a deformity such as a cavity sized and shaped to receive at least a portion of a patient's buttocks. Such a mattress cushion may include an attachment feature for securing the mattress cushion to an existing mattress.

Unlike mattresses used for pregnancy, the mattresses defined herein do not have a cavity configured to cradle the abdominal region of the women. Rather, the deformity employed in various embodiments disclosed herein can be a depression or an area of more deformable fabric in the location where a surgically reconfigured body mass will rest. In some embodiments, the depression or area of more deformable fabric is sized, shaped, and positioned for a particular surgically reconfigured body mass. In some embodiments, a depression is sized, shaped, and positioned to avoid all or substantially all contact with the surgically reconfigured body mass. In embodiments having a more deformable fabric, the fabric is more deformable than relatively stiffer fabrics used adjacent to the position of the reconfigured body mass. The stiffer fabrics will absorb most of the pressure to that portion of the body such that the reconfigured body mass has minimal pressure applied.

Moreover, unlike donuts currently used following hemorrhoid surgery, various embodiments disclosed herein form an entire support structure, such as an entire seat, mattress, or mattress pad. Additionally, unlike the small holes present in hemorrhoid donuts, various embodiments disclosed herein are configured to minimize pressure on all or substantially all of a body portion, such as the buttocks. In addition, unlike a hemorrhoid donut, some embodiments disclosed herein are configured such that it is not immediately visually apparent that the device is a medical device. For example, in some embodiments, the expandable nature of the device and/or the presence of a deformity within the device is not visually obvious. In some embodiments, such features are hidden by forming the device with appropriately selected materials. In some embodiments, such features are hidden by covering the device with an aesthetic cover. In some embodiments, the deformity is transient, only forming within the device upon contact between the device and a deformity generator. For example, in one such embodiment, the device contains a phase transition gel, which is relatively solid and firm at room temperature but which becomes substantially liquid upon the application of an electromagnetic signal. In such an embodiment, an electromagnetic signal transmitter may be disposed within a bandage or other accessory worn by the patient at the location of the injury or surgical site.

In some embodiments, such as any of the embodiments described above or elsewhere herein, at least a portion of the device may be shaped and configured to conform, at least in an expanded state, to one or more contours of the body. Additionally or alternatively, in any of the embodiments described herein, the device may include a securement mechanism for securing a cover to said device.

Another aspect of the disclosure relates to a kit for limiting reconfiguration of tissue that has been recently placed and shaped into a portion of a patient's body. In various embodiments, the kit includes a support device such as any of the support devices described above or elsewhere herein. The kit also includes a carrying case. In some embodiments, the kit additionally or alternatively includes a cover having a securement mechanism for securing the cover to the support device.

Still another aspect of the disclosure relates to a method for limiting reconfiguration of a tissue that has been recently placed and shaped into a portion of a patient's body. In various embodiments, the method includes providing a shape-memory support device having at least a portion which is expandable, and which, when expanded, is shaped to include a deformity that restricts the application, onto said tissue, of a pressure sufficient to cause undesired reconfiguration of said tissue. The method also includes positioning the device, in an expanded configuration, on or under a patient for one or more periods of anticipated pressure application in order to restrict the application of pressure on said tissue. The method may also include expanding the device. In some embodiments, the method is performed when the tissue has been placed and shaped in the patient's body within the past three months.

An additional aspect of the disclosure relates to a method of manufacturing a shape-memory support device configured to limit reconfiguration of cosmetically augmented tissue in a portion of a patient's body. In various embodiments, the method includes identifying one or more expected reconfigured dimensions of a body portion. The method further includes forming the support device such that at least a portion of the device is expandable, wherein the expanded device shape is selected based, at least in part, on said expected reconfigured dimensions. In various embodiments, the device is formed such that, when expanded, its shape creates a deformity that restricts the application, onto an augmented tissue, of a pressure sufficient to cause undesired reconfiguration of said tissue.

DETAILED DESCRIPTION

Figure 1:
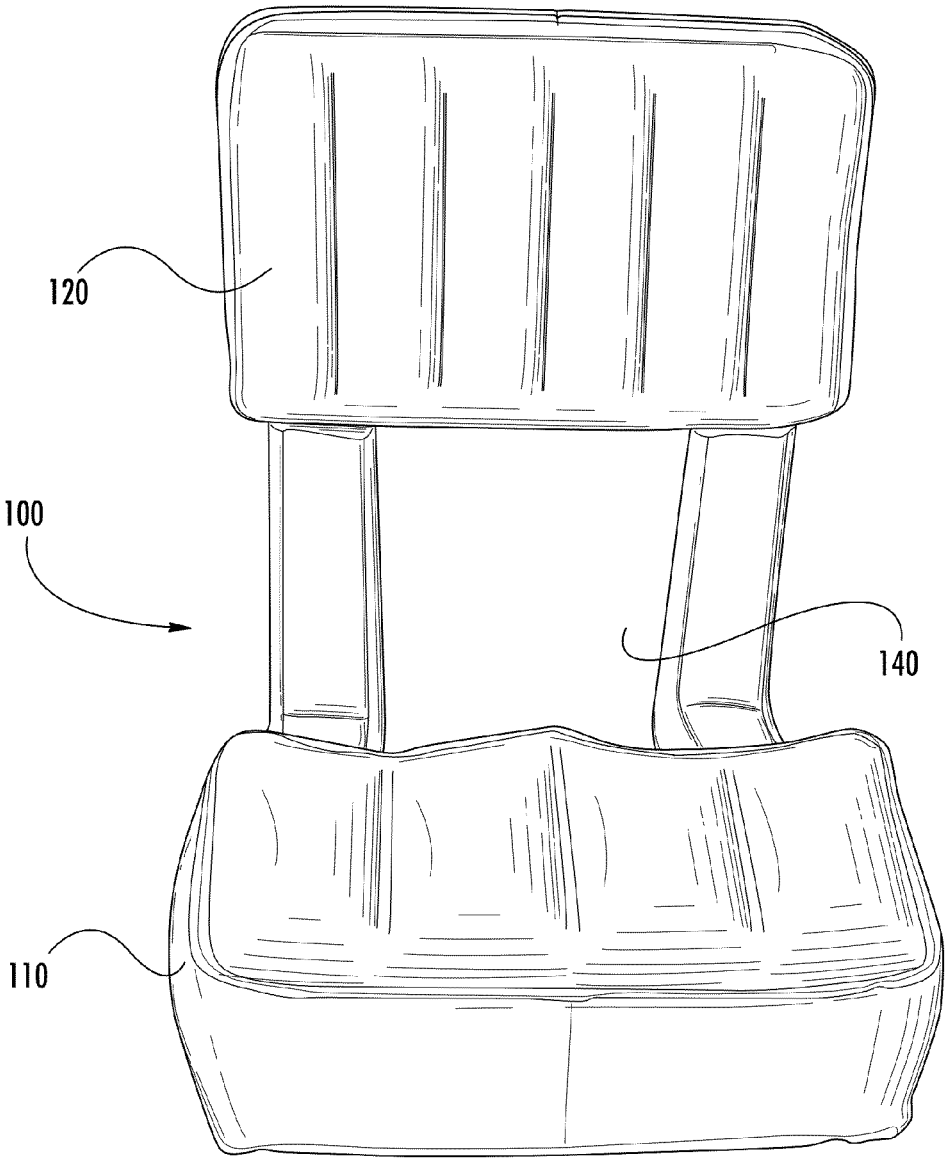
FIG. 1 depicts a front perspective view of one embodiment of a support device configured to provide support to an individual in a seated position.

In the following detailed description, reference is made to the accompanying drawings, which form part of the present disclosure. The embodiments described in the drawings and description are intended to be exemplary and not limiting. As used herein, the term "exemplary" means "serving as an example or illustration" and should not necessarily be construed as preferred or advantageous over other embodiments. Other embodiments may be utilized and modifications may be made without departing from the spirit or the scope of the subject matter presented herein. Aspects of the disclosure, as described and illustrated herein, can be arranged, combined, and designed in a variety of different configurations, all of which are explicitly contemplated and form part of this disclosure.

Unless defined otherwise, all technical and scientific terms used herein have the same meanings as commonly understood by one of ordinary skill in the art to which this disclosure belongs. In accordance with the claims that follow and the disclosure provided herein, the following terms are defined with the following meanings, unless explicitly stated otherwise.

The term "about" or "approximately," when used before a numerical designation or range (e.g., pressure or dimensions), indicates approximations which may vary by (+) or (−) 5%, 1% or 0.1%.

As used in the specification and claims, the singular form "a", "an" and "the" include both singular and plural references unless the context clearly dictates otherwise. For example, the term "a tissue" may include, and is contemplated to include, a plurality of tissues. At times, the claims and disclosure may include terms such as "a plurality," "one or more," or "at least one;" however, the absence of such terms is not intended to mean, and should not be interpreted to mean, that a plurality is not conceived.

As used herein, the term "comprising" or "comprises" is intended to mean that the devices, systems, and methods include the recited elements, and may additionally include any other elements. "Consisting essentially of" shall mean that the devices, systems, and methods include the recited elements and exclude other elements of essential significance to the combination for the stated purpose. Thus, a device or method consisting essentially of the elements as defined herein would not exclude other materials or steps that do not materially affect the basic and novel characteristic(s) of the claimed invention. "Consisting of" shall mean that the devices, systems, and methods include the recited elements and exclude anything more than a trivial or inconsequential element or step. Embodiments defined by each of these transitional terms are within the scope of this disclosure.

As used herein, "shape-memory device" shall mean any device that is able to assume more than one shape, but which has a pre-determined and specified shape that is reassumed under particular conditions. For example, an inflatable device is contemplated to be a shape-memory device in that it can assume various shapes of varying degrees of fullness or inflatedness, but when fully inflated, the device repeatedly assumes substantially the same, pre-determined shape.

"Undesirable reconfiguration" or just "reconfiguration" of tissue shall mean sliding, flattening, or other deformation or displacement of tissue. The term shall also include or refer to reabsorption of augmented tissue.

As used herein, "cavity" shall mean an empty space, gap, or crevice within a structure.

As used herein, "deformity" shall mean any inconsistency or distortion in a material or structure. The term shall include any cavity extending through a structure or depression extending partially through a structure. The term shall also include any area disposed within the structure having different material properties than the surrounding areas of the structure.

As used below, "injury," "injured portion," or "injured site" shall refer to a broken bone, a bruised body portion, a flesh wound, a surgical site, or any other site of trauma in or on a body.

Following many surgeries, patients are instructed to limit the application of pressure to healing surgical sites. Avoiding pressure while sitting or lying down can be a particularly difficult and inconvenient task. Embodiments disclosed herein relate to support devices and related methods for improving the post-operative recovery experience. Moreover, during certain surgeries, such as for example, surgeries involving augmentation of multiple surgical sites, it may be necessary to reposition a patient onto a surgical site. In order to avoid adverse effects to the surgical site, it would be advantageous to avoid applying pressure onto said site. Embodiments disclosed herein also relate to support devices and related methods for use during such surgeries.

Various embodiments are directed to devices and methods which distribute a patient's weight away from an injury when the patient is in a seated or prone position, thereby limiting or eliminating the application of pressure to the injury. While some embodiments disclosed herein focus on one or more operative or post-operative contexts, it will be appreciated by those skilled in the art that the support devices described herein may be used to improve the experience during or after any surgery or physical injury. Specifically, the described support devices limit the application of pressure to any injured and/or healing portion of a body through targeted distribution of an individual's weight away from the injured body portion.

For example, the support devices of some embodiments are in the form of chairs, seats, or seat cushions which are specifically configured to distribute weight away from locations where pressure is typically exerted when seated—the buttocks, hips, lower back, and/or upper thighs. Such devices may be used to improve the recovery experience of someone healing from any injury or surgery to the buttocks, coccyx, anus, rectum, hips, or other similarly located body structures. As non-limiting examples, such devices may improve the recovery experience for patients following buttocks augmentation, hip surgery, or a tailbone fracture.

In other examples, the support devices of some embodiments are in the form of mattresses, mattress pads, or pillows specifically configured to distribute weight away from particular locations where pressure is typically exerted when in a prone position. For example, in some such embodiments tailored to back sleepers, pressure may again be redistributed away from the buttocks, hips, lower back, and/or upper thighs. In another embodiment tailored to back sleepers, pressure may be redistributed away from the upper back and/or shoulders. In embodiments tailored to side sleepers, pressure may be redistributed away from the hips or upper back and/or shoulders. In various embodiments tailored to stomach sleepers, pressure may be redistributed away from the breasts or the cheeks. In some embodiments, pressure may be redistributed away from any portion of the body that has sustained an injury.

The structure of some exemplary devices is further described herein. In various embodiments, the support device is volumetrically expandable and/or deformable and configured to transition between a fully-deployed state and a collapsed, partially collapsed, and/or deformed state. In the fully-deployed state, one or more walls of the device define a structure configured to physically support and cushion at least a portion of a body.

In the fully-deployed state of some embodiments, one or more of the walls also form a barrier defining a deformity within the structure. The deformity of various embodiments is sized and shaped to receive an injured portion of the body within or atop the deformity.

For example, in some embodiments, the entire injured site, such as the entire augmented tissue, fits within a cavity or depression defined by the walls of the device so that no portion of the injured site comes into contact with the device. In some such embodiments, the device has a height, in its fully-deployed state, sufficient to also prevent the injured site from contacting any surface disposed below the device. In such embodiments, no pressure is applied to the healing site.

In other embodiments, a cavity or depression in the device may allow a small portion of the injured site, such as a perimeter of the site, to contact the support device and be subjected to the application of pressure.

In other fully-deployed embodiments, one or more walls of the device define the perimeter of an area of the device having different material properties than said walls. Particularly, the device of some embodiments has an area of significantly less stiffness than the surrounding areas of the device. For example, in some embodiments, the device, at the location of the deformity, is extremely plush and/or deformable. This plush/deformable portion is at least partially surrounded by areas of greater firmness and support. In other such embodiments, the deformity includes an extremely elastic material secured atop a cavity or depression. The plush, deformable, and/or elastic material provides little resistance when a force is applied against it, thereby minimizing pressure exerted on a body pressing against the material. In some embodiments, the deformity is sized and shaped so that when the device is positioned under an individual, all or substantially all of the injured site is disposed on the deformity. An individual's weight is thereby distributed substantially away from the injured site. The individual's weight is distributed primarily to the stiffer, more supportive portions of the device configured to support such weight.

In still other embodiments, at least a portion of the support device, for example, a top surface or a portion thereof, is formed of a phase transition material. In some such embodiments, said phase transition material is a phase transition gel, such as, for example, any embodiment of a phase transition gel described in U.S. Pat. No. 5,830,207 to Leeb et al., which is herein incorporated by reference in its entirety. Such a material transitions from a solid or substantially solid state to a liquid or substantially liquid state in response to a particular trigger, such as, for example, temperature or electromagnetic radiation. In some embodiments, the support device includes a top layer formed of a phase transition gel that is, for example, 0.25 inches thick. In other embodiments, the layer of gel is 0.5 inches thick, 3 inches thick, or any value there between. In other embodiments, all or substantially all of the support device is formed of the phase transition gel. In various embodiments, the phase transition gel is covered by, and/or contained within, a layer of neoprene, elastane, polyurethane, or other flexible material. In a preferred embodiment, the gel transitions from a solid state to a liquid state in response to receiving targeted electromagnetic radiation, such as a radiofrequency signal or directed waves in the infrared, visible light, or ultraviolet range. In various embodiments, the transition is localized such that the transition substantially from a solid to a liquid occurs only to portions of the gel in contact with, or in close proximity to, an electromagnetic radiation transmitter. In some embodiments, patients are provided a bandage or other accessory for placement over their injury. One or more radiofrequency transmitters, such as a Bluetooth®, Wi-Fi, or near field radio transmitter are disposed within the accessory. In such embodiments, all or substantially all of the gel in the support device is in a solid state when not in use or when used without the appropriate accessory. Upon contacting the accessory to the support device, the portion of the gel positioned below the bandage or other accessory transitions substantially or entirely to a liquid. In various embodiments, only the gel portion positioned below the accessory liquefies. The liquefied portion of gel returns to a solid or substantially solid state upon terminating contact between the support device and the accessory. In various embodiments, the liquid gel portion provides little resistance or pressure to a body portion resting atop the liquid gel portion. In such embodiments, a patient's weight is thereby distributed substantially away from the injured site and placed primarily onto other portions of the patient's body positioned on the solid-state gel portions.

In various embodiments of the support device described herein, contact with, and pressure on, the injured site is minimized so that if any pressure is applied, it is insufficient to cause damage to the injured site. For example, in some embodiments, the application of pressure is restricted so that it is insufficient to cause unwanted reconfiguration of augmented tissue. In some embodiments, the application of pressure is restricted so that it is limited to no more than 20 kPa; in some embodiments, pressure application is restricted to no more than 10 kPa, and in some embodiments, pressure application is restricted to no more than 5 kPa. In other embodiments, different limits to pressure application are achieved. In various embodiments, the majority of the pressure caused by a patient's own weight is instead distributed to surrounding portions and/or remote portions of the patient's body.

In various embodiments, one or more walls defining the structure of the device are configured to provide a comfortable support surface, which cushions the body portions coming into contact with the walls, such as, for example, body portions surrounding the injured site as well as body portions remote from the injured site. For example, in some embodiments, the one or more walls are curved to eliminate any hard edges or sharp corners that could cause unwanted pressure points (i.e., areas of excessive and uneven distribution of pressure). Additionally, the walls are of a sufficient strength and the device is of sufficient depth to prevent any direct application of force between a surface disposed below the device and the supported portions of a body.

Any suitable cushioning mechanism or material may be used to achieve a comfortable support surface that sufficiently elevates an individual. For example, in some embodiments, the device is formed of a semi-deformable foam. In other embodiments, the walls are made of canvas, spun cotton, polyester, spandex, other natural or synthetic fabrics, leather, or other materials and are filled with a semi-deformable filler. For example, in some embodiments, the walls define an interior filled with foam or plastic pellets to create a "bean bag" cushion. In other embodiments, the walls define an interior filled with plush padding made, at least in part, of down, synthetic down, cotton, wool, or other natural or synthetic materials. In such embodiments, the material forming the walls must be relatively taut and inelastic and the filler sufficiently plentiful in order to give the device sufficient structure and depth to support and elevate an individual. In other embodiments, such as embodiments described above, the filler is a semi-deformable gel. In some such embodiments, the gel is a phase transition gel. In various embodiments, the materials forming the device are selected to have material properties that balance cushioning with support. For example, in some such embodiments, materials are selected which limit deformation to ensure the structure is firm enough to limit lateral expansion of the support device in the direction of the deformity. Deformable embodiments are said to be in a fully-deployed state when non-deformed.

In other embodiments, the device is inflatable or otherwise expandable. In such embodiments, at least a portion of the device expands in volume. In the expandable portion, the walls of the device define one or more enclosed inner chambers configured to be filled with fluid. In some embodiments, the one or more walls define a single inner chamber. In other embodiments, the one or more walls define a plurality of inner chambers provided to help the support device achieve and maintain a desired shape. As fluid enters into each of the one or more inner chambers, the walls move radially outward and the volume of the inner chamber expands. The fully-expanded state of such devices may be achieved by filling each chamber with a fluid such as air, carbon dioxide, or water. The walls of such embodiments are formed of a fluid-tight material (e.g., water-tight and/or air-tight material) to retain the fluid and achieve a supportive, compliant, and cushioning structure. Moreover, the walls are formed of a durable, flexible, and puncture-resistant material. Example materials for the walls include poly(vinyl chloride) (PVC), polyurethane (PU), a PVC/PU-coated nylon composite, synthetic rubber, other polymers, or other materials. In some embodiments, the walls are formed of a biodegradable and/or recyclable material. In some, non-limiting examples, the walls are formed of a polymer having a thickness of, for example, 0.1-2.0 mm, and in some embodiments, the walls have a thickness of, for example, about 0.15 mm, about 1.0 mm, or any value therebetween. In some embodiments, each chamber is formed, for example, of one or more sheets of polymer sealed on all edges through the use of high frequency welding, glue, or other adhesive to form air-tight seams.

In some embodiments, the device is a standalone structure. In other embodiments, the device includes an attachment feature for securing the device to existing furniture. The attachment feature may include, for example, one or more straps, ties, snaps, zippers, a fitted base, etc. In some such embodiments, the device is portable and removably coupled to said existing furniture, such as, for example, a chair, stool, gurney, bed, mattress, wheelchair, vehicle seat, etc. In some embodiments, the device is configured to couple to a plurality of sizes and/or models of a piece of furniture, for example, to various chairs or various beds or mattresses. In other embodiments, the device is specifically designed to couple to a particular piece of furniture, said furniture piece having complementary features specifically designed to fit with, and couple to, the support device.

In some expandable embodiments, the entire device is expandable. In other embodiments, only a portion of the device expands volumetrically. For example, in various devices, one or more cushions are expandable; however, one or more attachment features may not be configured to volumetrically expand. Additionally or alternatively, in some embodiments, one or more support structures, such as posts, rods, or springs, may not be volumetrically expandable. The device of some embodiments also includes accessories such as covers or handles that may not be expandable.

In one embodiment, the device is formed in the shape of a seat having a bottom seat cushion and a back seat cushion. The cushions are coupled and oriented to define a cavity. Only the bottom seat cushion is expandable; the non-expandable back seat cushion may be permanently attached or removable. In another embodiment of a seat having a bottom seat cushion and a back seat cushion, both cushions and the support structure connecting the cushions are expandable. In another embodiment, the support structure is rigid and not expandable. In a similar embodiment, the seat cushion also includes a handle attached for improved portability. The handle may or may not be expandable.

In some embodiments that are expandable via inflation, the support device includes one or more valves. These valves have both an open state (in which fluid may pass through the valve) and a closed state (in which the flow of fluid into and out of the inner chamber(s) of the support device is minimized or eliminated). In some embodiments, the valves have two open states: an intake state in which fluid may flow into, but not out of, the inner chamber(s) of the support device, and an output state in which fluid may flow freely out of, but not into, the inner chamber(s). In some embodiments, the valve is an oral inflation valve. Such a valve is formed of a polymer tube defining a channel. The valve includes a polymer plug, which occludes fluid flow through the valve when the plug is disposed within the channel of the valve. In other embodiments, other valve configurations are used, such as Presta valves or Schrader valves common on bicycle tires, one-way valves requiring insertion of a needle into the valve to insert or remove fluid, a valve with a built-in pump, or any other one-way or two-way valve design.

In various embodiments, the inner chamber(s) of the support device are configured to be filled with fluid through the use of any suitable inflation mechanism. Non-limiting examples of suitable inflation mechanisms include: connecting a water hose to the valve and filling with water, blowing air into the valve stem; using a manual hand pump or foot pump to push air through the valve; connecting the valve to a carbon dioxide cartridge and releasing carbon dioxide through the valve; connecting to a mechanical pump with or without a needle and pushing air through the valve; and using a battery-powered inflator, an AC inflator, or a DC inflator, each of which uses a fan to force air into the inner chamber.

In some embodiments, the support devices are configured for repeated use and can be both inflated and deflated. In such embodiments, the expandable portions of the support device can be deflated using any suitable deflation mechanism, such as for example: opening a two-way valve to release the pressure and gas within the inner chamber(s), or running a pump to expel air or other gases or water from the inner chamber. Such embodiments of the support devices are also portable. For example, in some embodiments, the devices are foldable and rollable when in a deflated (i.e., collapsed) state. In some embodiments, a tie string, drawstring, cinch tie, hook and loop device (e.g., Velcro®) strap, strap with snaps, an elastic band, a bag, or other containment mechanism may be used to hold the support device together in a compact configuration once deflated and folded. In some such embodiments, the support device is configured to fit in a purse, tote bag, or other portable carrying case when in a compact configuration. The support device of some embodiments is configured to undergo a reduction in volume of 1%, 99%, or any value there between from the fully-deployed state to the compact configuration. In some embodiments, the support device undergoes a reduction in volume of at least 50% from the fully-deployed state to the compact configuration.

In other embodiments, the support device is not portable, but rather, is integrated into a piece of furniture. In some such embodiments, cushions having one or more deformities are disposed on top of, and connected to, a structure such as a chair or bed. For example, in one embodiment, a chair, such as a desk chair or arm chair, includes one or more cushions, such as a seat cushion and/or a back cushion having one or more of the properties described elsewhere herein. In other embodiments, surgical tables, gurneys, and/or hospital beds each have a top mattress portion having one or more of the properties described elsewhere herein.

In some embodiments, the support device further includes a cover configured to improve the aesthetic look and/or comfort of the device. The cover of some embodiments is integrated into the support device. For example, in various embodiments, the cover is molded or adhered to one or more surfaces of the support device. In other embodiments, the cover is removable, and accordingly, interchangeable. With interchangeable covers, varying degrees of softness or plushness can be selected by a user and various designs can be displayed. In such embodiments, the covers may include one or more securement features to securely couple the cover to the support device. For example, the cover may be fitted with elastic along the edges of the cover, and/or the cover may include zippers, snaps, hook and loop devices (e.g., Velcro®), straps, or other securement features. In some embodiments, the support device includes complementary securement features. For example, some embodiments of the support device have snaps molded or adhered to, and spaced along, a perimeter of the top surface, along the side surfaces, and/or on the bottom surface. Such snaps are configured to couple to the snaps of appropriately sized covers. In other embodiments, the snaps are replaced with zippers, hook and loop devices (e.g., Velcro®), loops, or small depressions/dimples within the surfaces of the device walls. In one example, each cover has a plurality of rivets or plugs sized to fit securely within small dimples or depressions formed within the surfaces of the device walls. The cover of various embodiments is at least disposed, or at least configured to be disposed, on the particular surfaces on which a patient rests, for example, the top surface of a mattress device. In some embodiments, the cover is configured to cover the entire device. Such a cover may be permanently attached to the support device on all sides or it may be formed as a removable sleeve or sheath. In other embodiments, the cover is configured to cover all visible sides of the device (e.g., everything but the bottom side). Covers of various embodiments may include an aesthetically pleasing pattern or design. Additionally or alternatively, embodiments of the cover may improve the texture of the support device, making it more soft and luxurious. In various embodiments, the cover, whether detachable or integrally coupled, is formed of a soft polyester, suede, fleece, other soft fabric, or other material. In various embodiments, the cover is sized and shaped with appropriate contours and an appropriate gap to match the contours and deformity of the support device. In some embodiments, the cover includes a portion of material extending into the cavity or depression, covering at least a portion of the wall surfaces that define the cavity or depression. In other embodiments, the cover is formed of an elastic material and shaped to extend over, and hide the presence of, a cavity or depression. In still other embodiments, the cover may extend around or over a deformity in the material of the device.

Additionally or alternatively, in some embodiments, a cover is configured to be detachably or integrally coupled to the bottom side of the support device, such cover including one or more traction features. For example, the bottom cover may include ribbing or tread patterns formed of polypropylene, other polymers, or other materials. In some embodiments, the bottom cover is an independent feature, in other embodiments, the bottom cover may form one side of an otherwise soft or decorative cover.

In some embodiments, the support device is configured to hide or substantially hide the deformity within the support device, so that the recovery-aiding properties of the device are not evident to outside observers. That is, in some embodiments, the device is made to look identical to, substantially identical to, or similar to a non-medical support device—for example, a seat cushion, a chair, an air mattress, or a mattress pad. In some such embodiments, the support device has a sleek design with one or more of the device walls formed of a relatively stiff material that provides for little deformation so that an individual can remain elevated on the support device and avoid experiencing any force from a surface under the device, even when the device is elevated, for example, by as little as 0.5 inches to 4 inches. In some such embodiments, an elastic or otherwise flexible cover is provided, which hides a cavity or depression. In other embodiments, the deformity is formed of a deformable material and the properties of the deformity are not readily apparent by observation.

A support device, such as any support device described herein, may be packaged as part of a kit. For example, in some embodiments, the support device is provided with a carrying case, such as a tote, satchel, drawstring bag, or other bag. Additionally or alternatively, in some kits, the support device is provided with a suitable means of inflation, for example any of the means of inflation described elsewhere herein. Additionally or alternatively, in some kits, the support device is provided with at least one cover for improved style, comfort, or traction. Additionally or alternatively, in some kits, the support device is provided with removable or non-removable straps, ties, or other securement features configured to secure the support device to existing support structures such as household chairs, office chairs, couches, beds, and mattresses.

Figure 2:
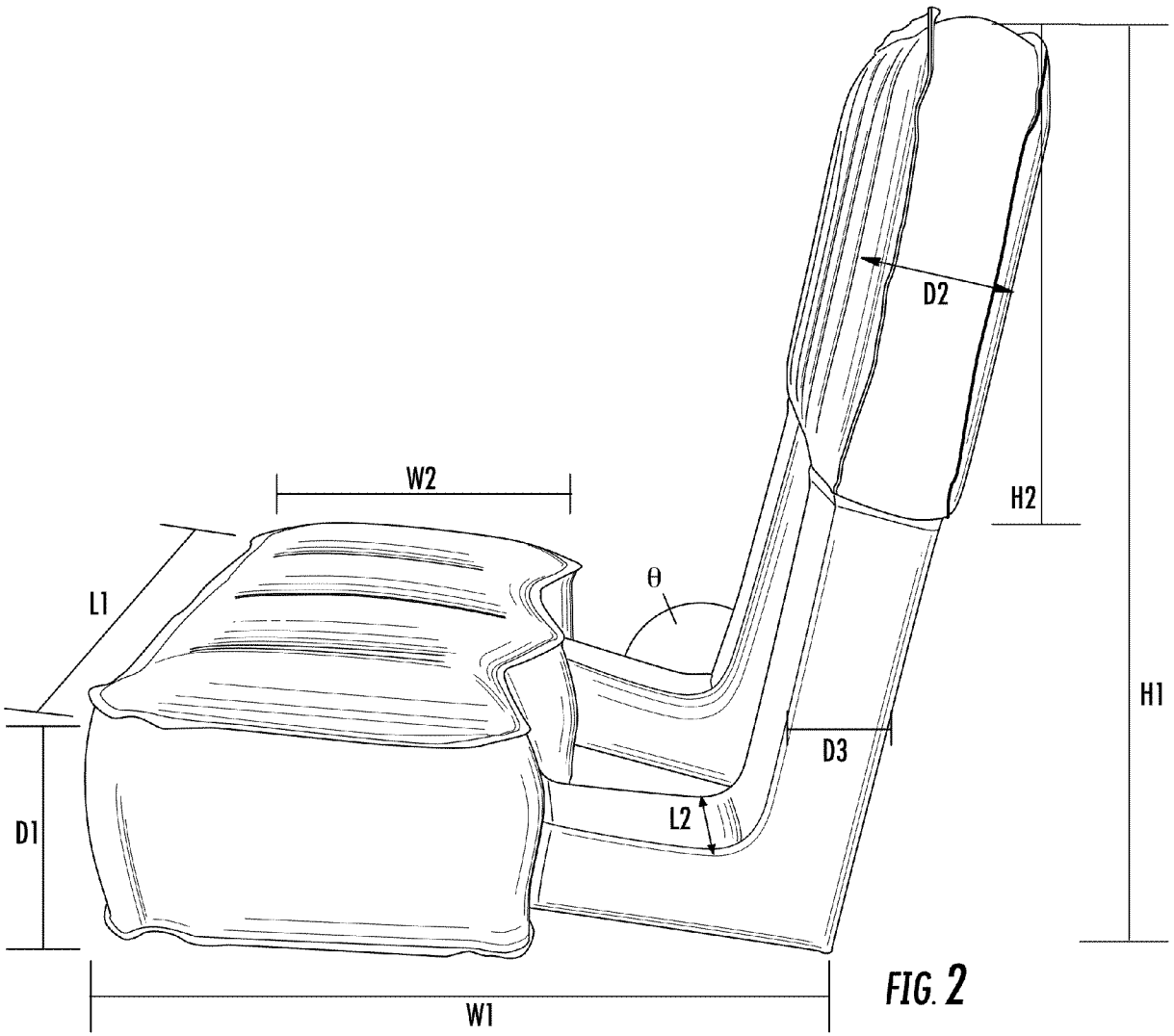
FIG. 2 depicts a right side perspective view of the support device embodiment of FIG. 1.
Figure 3:
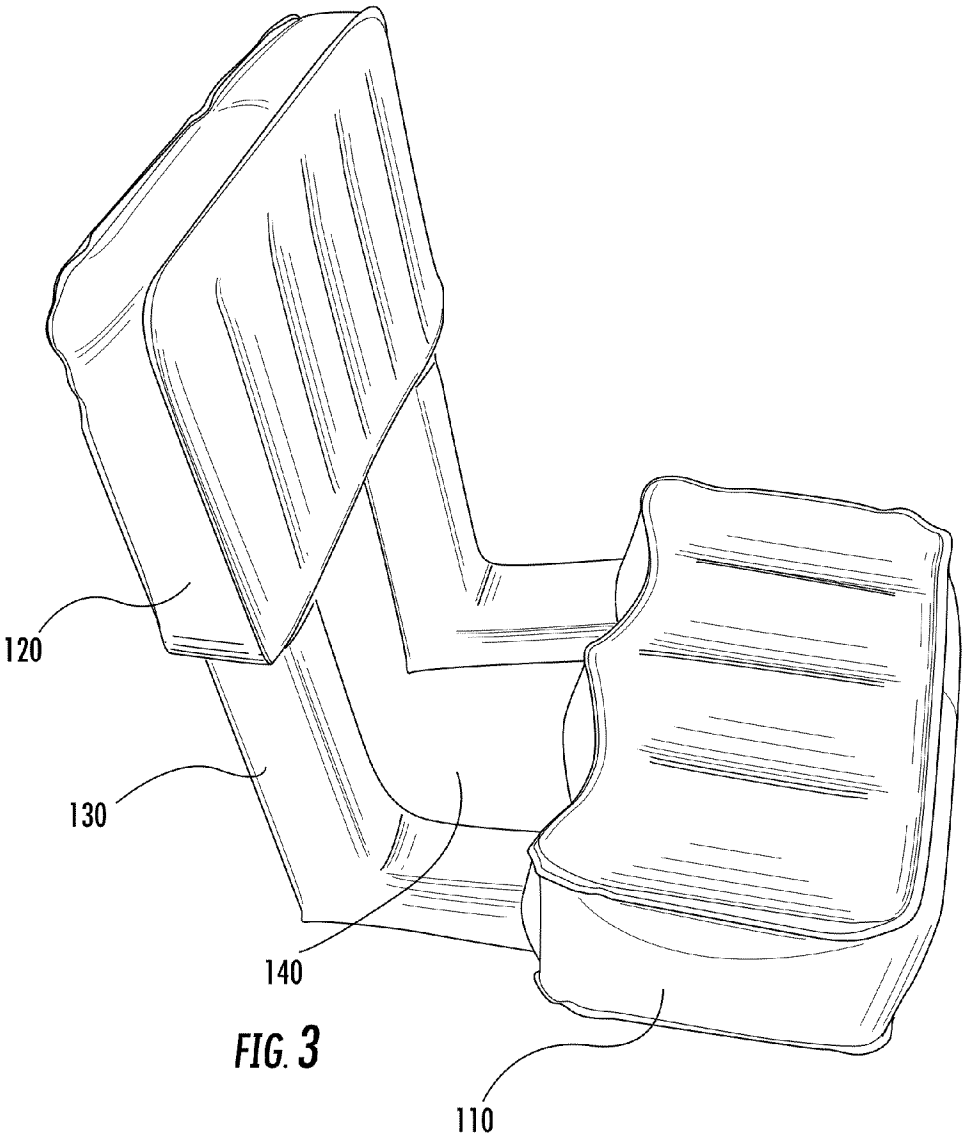
FIG. 3 depicts a left side perspective view of the support device embodiment of FIG. 1.
Figure 4:
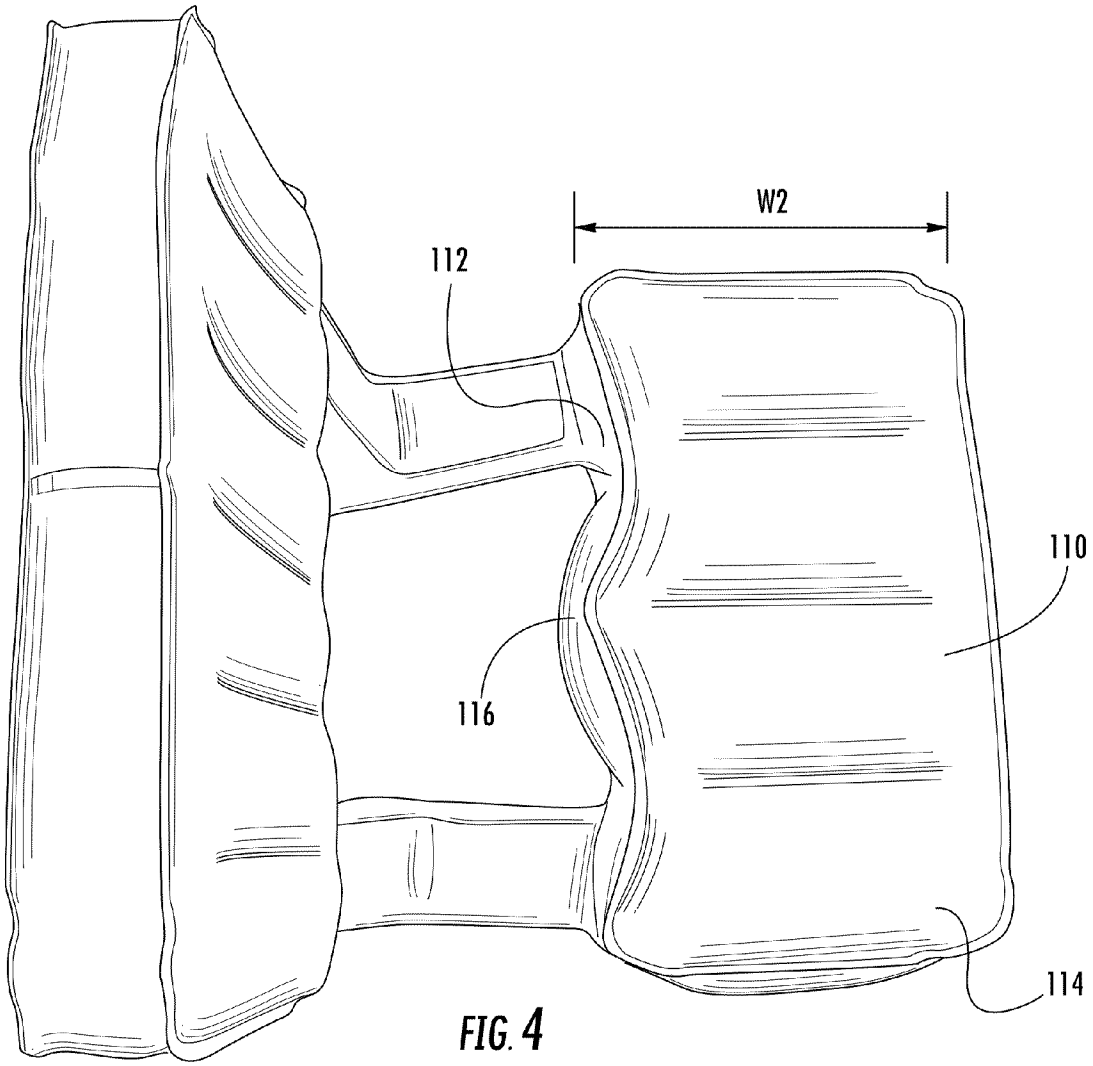
FIG. 4 depicts a top view of the support device embodiment of FIG. 1.

One example of a support device is illustrated in FIGS. 1-5. The support device includes a first inflatable cushion 110 and a second inflatable cushion 120 positioned at an angle θ to form a seat 100. In other embodiments, the support device may include one curved cushion having a first portion disposed at an angle relative to a second portion. In various embodiments, the angle is 80-180 degrees. As shown in FIG. 2, in some embodiments the angle θ is 90-120 degrees. The cavity 140 is positioned at the junction between the first cushion 110 and the second cushion 120 and is defined, at least in part, by the walls of each cushion. At least a portion of the walls of the support device are contoured to form a deformity in the form of a cavity 140. The cavity 140 comports to a portion of a patient's body and receives a patient's buttocks. For example, as shown in FIG. 4, a wall 112 of the first cushion 110 is contoured to hug the buttocks and provide the greatest space in the cavity at the locations where the buttocks is largest. As shown, for example, in FIG. 3, the seat 100 of the provided embodiment also includes two inflatable support posts 130, which couple the cushions 110, 120 together and orient the first cushion 110 relative to the second cushion 120. The support posts 130 further define the cavity 140.

Figure 5:
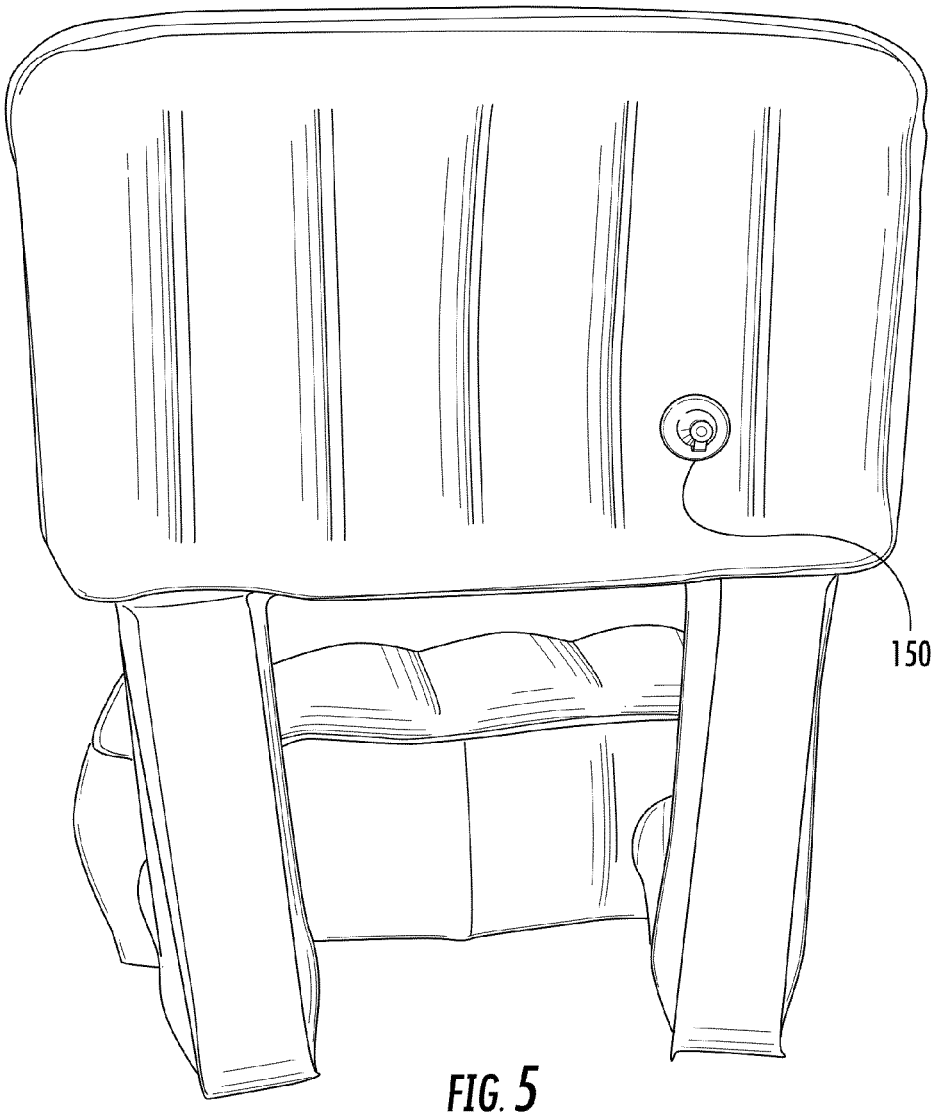
FIG. 5 depicts a rear view of the support device embodiment of FIG. 1.
Figure 6:
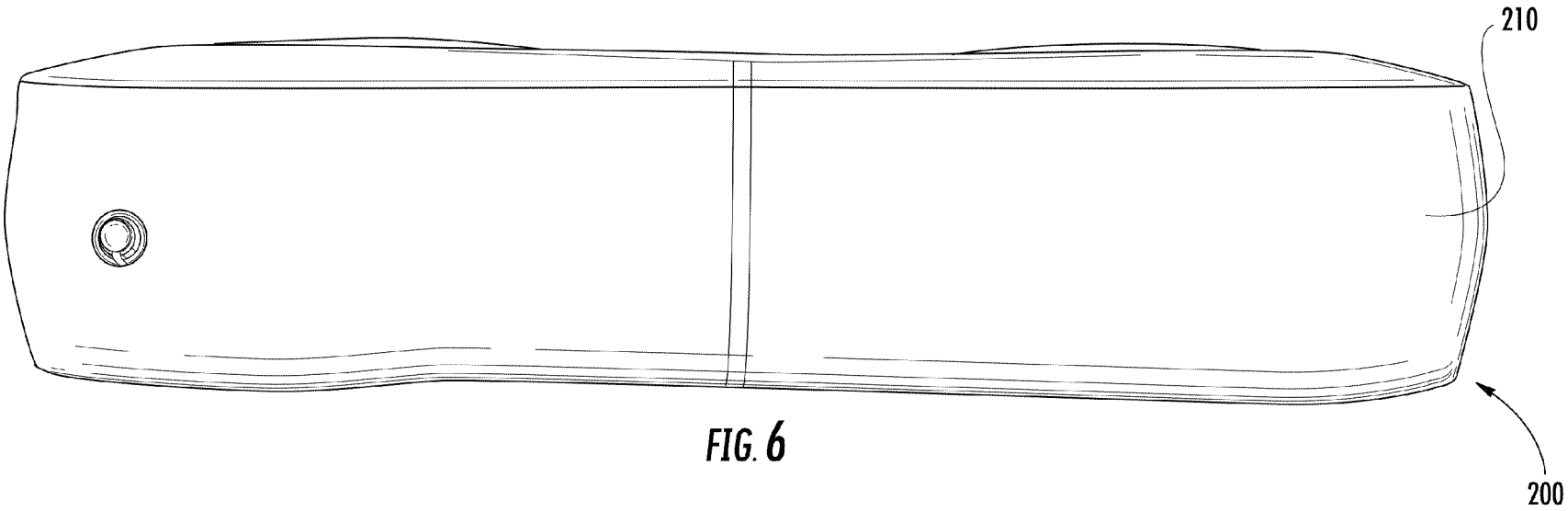
FIG. 6 depicts a side view of one embodiment of a support device configured to provide support to an individual in a prone position.
Figure 7:
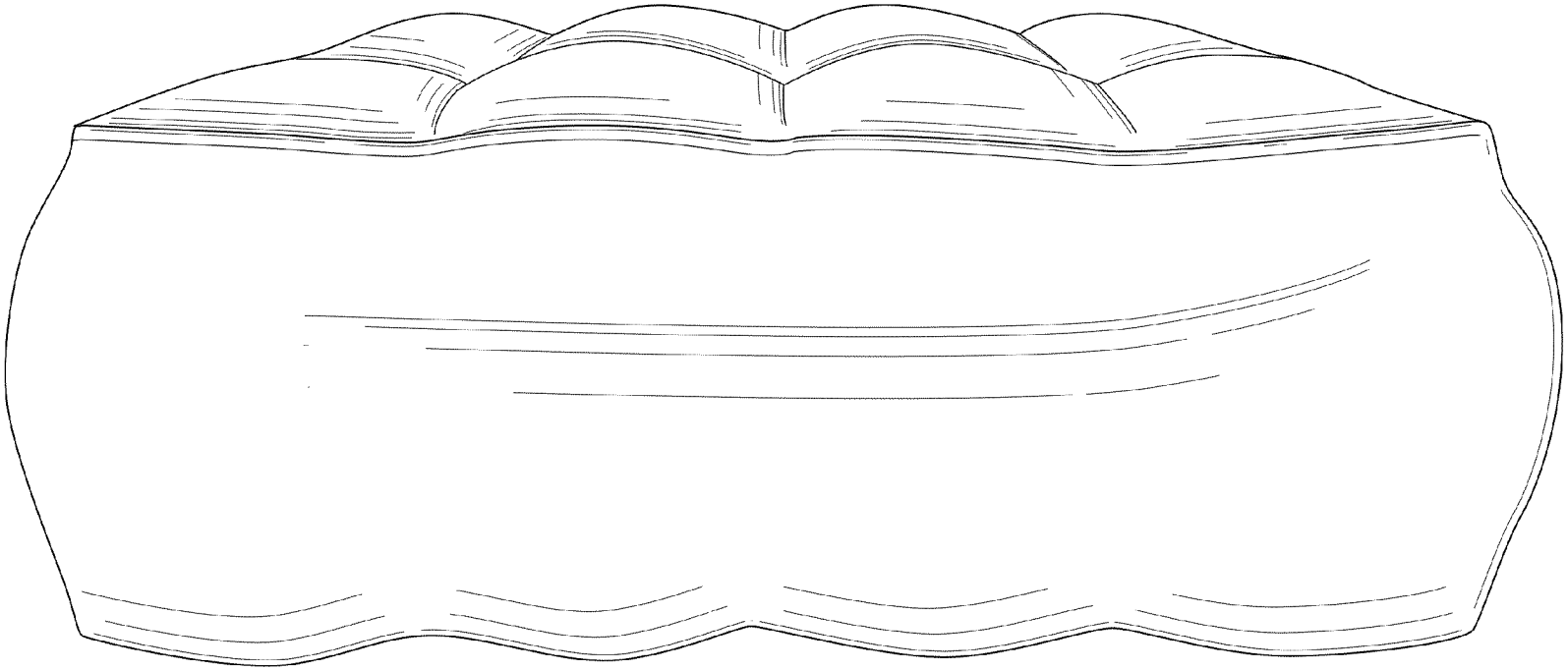
FIG. 7 depicts a front perspective view of the support device embodiment of FIG. 5.
Figure 8:
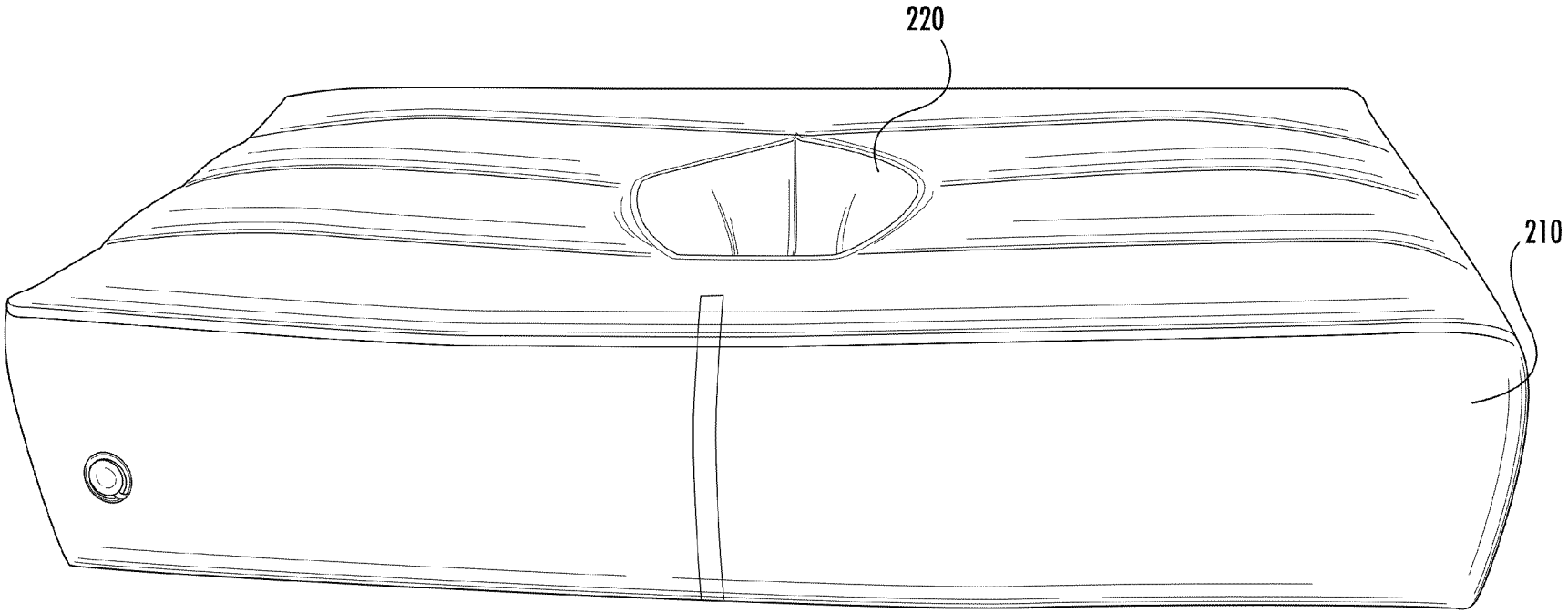
FIG. 8 depicts a side perspective view of the support device embodiment of FIG. 5.
Figure 9:
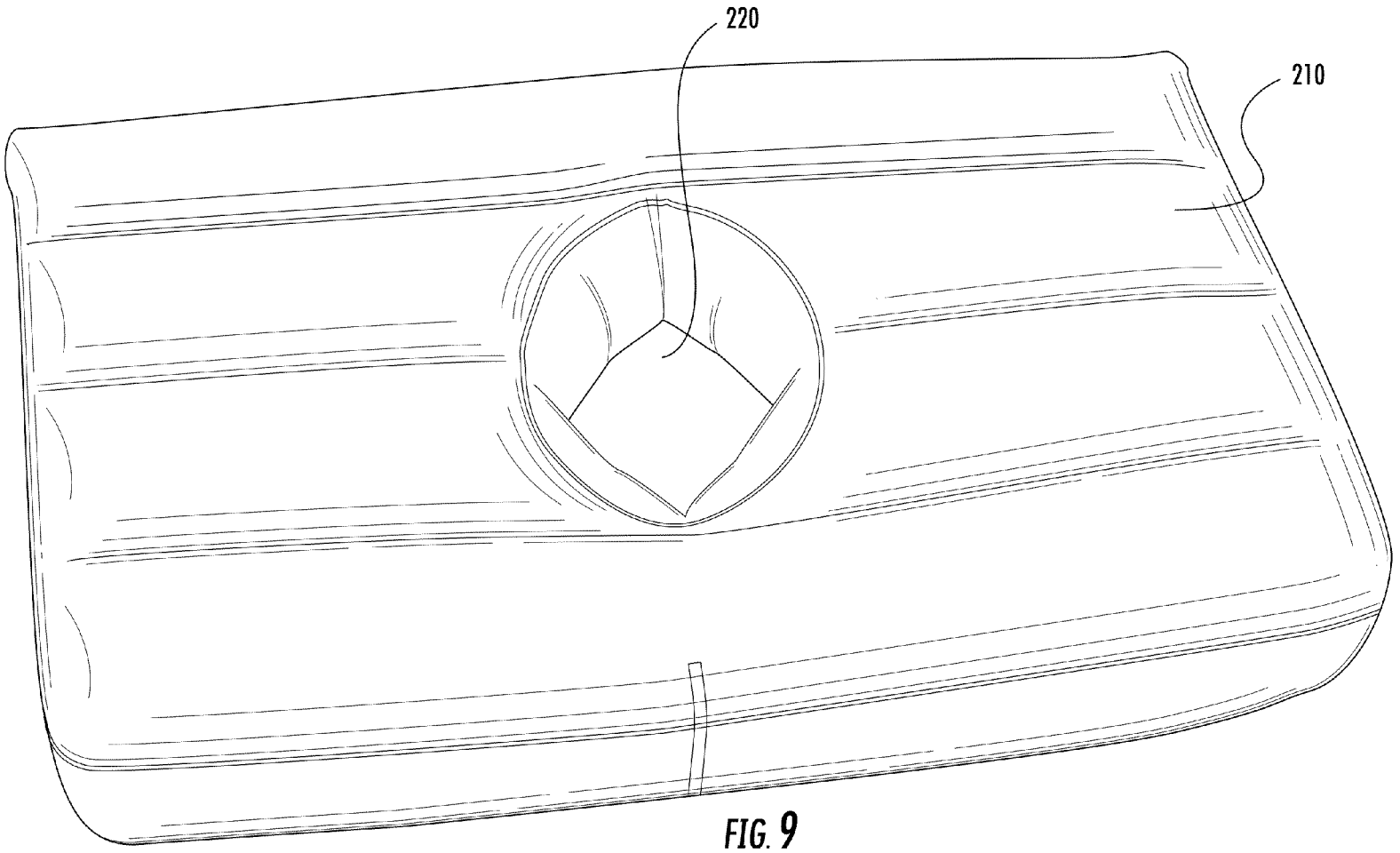
FIG. 9 depicts a top perspective view of a portion of the support device embodiment of FIG. 5.

The outer walls of the first cushion 110, second cushion 120, and support ports 130 each define inner chambers, which are connected and in fluid communication with each other. In such a configuration, the support device (i.e., the seat 100) inflates and deflates as a single unit. All portions of the device 100 are inflatable and deflatable, and when fluid is removed from the inner chambers, such that the device 100 deflates, the device can be folded or rolled into a compact configuration, undergoing, for example, a 50-98% decrease in volume relative to the depicted, fully-deployed state. As shown in FIG. 5, the presently illustrated embodiment has an oral inflation valve 150. The device can be used repeatedly and can be inflated by blowing air into the oral inflation valve 150 and deflated quickly by opening the valve and releasing air from the inner chamber.

In one embodiment, such as the illustrated embodiment, in a fully-deployed state, the device 100 is configured for an average-sized adult female. In one, non-limiting embodiment, the device has a length (L1) of 17.5 inches, a width (W1) of 16.25-20.25 inches, and a height (H1) of 23 inches. The first cushion 110 has a width (W2) of 8.25-10.25 inches and the second cushion has a height (H2) of 11.25 inches. The first cushion 110 has a depth (D1) of 5.75 inches, the second cushion 120 has a depth (D2) of 3 inches, and each support post 130 has a depth (D3) of 1.25 inches. The length of each post 130 is 3 inches. In some embodiments, the depth of a cushion is greatest at locations of greatest pressure application. Such a configuration ensures a patient remains sufficiently elevated so as to avoid having any portion of the patient's buttocks contact the surface disposed under the seat 100. In another example, the device may have a length (L1) of 15 inches, 30 inches, or any value there between. The device may have a width (W1) of 15 inches, 30 inches, or any value there between. The device may have a height (H1) of 12 inches, 36 inches, or any value there between. W2 may be 6 inches, 16 inches, or an value there between. H2 may be 3 inches, 30 inches, or any value there between. D1, D2, D3, and L2 each may be 1 inch, 8 inches, or any value there between. As shown in FIG. 5, in some embodiments, the first cushion 110 includes two contours 112 defined by curves disposed along an edge of a top wall 114 and matching curves formed in the shape of a contoured side wall 116. The curves are each configured to create space for a single buttocks cheek. In some embodiments, the difference between the widest portion and narrowest portion of the width (W2) of the first cushion 110 is, for example, 1 inch, 4 inches, or any value there between.

Another example of a support device is illustrated in FIGS. 6-9. The device includes an expandable elongated cushion 210 forming a mattress 200. The device 200 has a deformity formed therethrough, the deformity defined by walls of the cushion 210. In the depicted embodiment, the deformity is in the form of a cavity 220 positioned near the center of the cushion 210 and configured to receive a buttocks when a patient is positioned on the mattress 200 in a prone position. In one non-limiting embodiment, the mattress 200 has a length of 75 inches, a width of 39 inches, and a depth of 15 inches. Such a device may be used on the floor as a stand-alone mattress. In other embodiments, the support device may have a smaller depth, for example, a depth of 2-6 inches, for use as a mattress pad atop an existing mattress. In some embodiments, the length may be 64 inches, 84 inches, or any value there between. In some embodiments, the width may be 18 inches, 84 inches, or any value there between. In some embodiments, the support device is sized and configured to rest atop and couple to an existing mattress and the width and length dimensions are selected to match a standard twin, double, queen, or king sized mattress. In some embodiments configured to fit a queen or king mattress, the deformity is not centered, but rather positioned off-center for use by an individual resting on one half/side of the device. In the depicted embodiment, the cavity 220 is oblong having a first diameter of 16 inches and a second diameter in a perpendicular direction of 17 inches. In other embodiments, other sizes and shapes may be selected. For example, the cavity 220 resembles two overlapping circles or ellipses, each sized to receive and conform to a buttocks cheek.

As will be appreciated by those skilled in the art, the above-provided examples of support devices are illustrative but non-limiting. In order for the support devices described herein to be useful to a diverse patient population, the support devices must be offered in a plurality of orientations, shapes, and sizes.

For example, while both of the examples described above target the same portions of a body (i.e., the buttocks), one is oriented for sitting and one oriented for sleeping or lounging in a prone position. Moreover, other support devices may be oriented to protect injury sites from pressure while standing or walking.

Returning for purposes of example to the elongated cushion having a deformity formed there through for use in a prone position, in some embodiments, the deformity is positioned near the center of the cushion, as described above. In other embodiments, the deformity is disposed in the elongated cushion approximately 12-25 inches from the front end of the cushion and is configured to receive breasts or the upper back. In another embodiment, the deformity is disposed closer to the back end of the cushion than the front end of the cushion and is configured to receive one or both thighs. It will be appreciated by those skilled in the art that the deformity may be positioned at one of a large variety of locations to accommodate the location of a particular injury. Additionally, a plurality of deformities may be present within one support device. For example, a pair of deformities may be present, each sized and shaped to receive, for example, one breast or one thigh. A single support structure may include, for example, one or more deformities for the breasts and one or more deformities for the buttocks. Moreover, the size and shape of the deformity may be modified to conform to the injured body part. For example, a deformity configured to receive breasts will be sized and shaped differently than a deformity configured to receive buttocks, upper back, thighs, or facial cheeks. As one non-limiting example, deformities for the buttocks or deformities for the breasts may each be in the shape of an ellipse or an ellipsoid. In another non-limiting example, deformities for the buttocks or deformities for the breasts may each be substantially shaped as two conjoined ellipses or ellipsoids. Such conjoined ellipses or ellipsoids may, for example, have a greater width than length, where width is measured across the width of the mattress. In contrast, a deformity for the thighs may be, for example, longer than it is wide. In one non-limiting example, deformities for the thighs and deformities for the upper back are each substantially shaped like a rectangle or rectangular prism, but with rounded corners.

Similarly, a deformity in a seated device, such as, for example, the support device of FIGS. 1-5, may be specifically sized, shaped, and positioned to conform to a particular injured body part. For example, in one embodiment, the seated support device has a longer first cushion than shown in FIGS. 1-5 and includes an elongated deformity contained entirely within the first cushion, said deformity sized, shaped, and positioned to receive at least a portion of one or both thighs. In other embodiments, the deformity is transient and moveable based on the location of the patient, for example, in embodiments including a phase transition material.

Additionally, it will be appreciated by those skilled in the art that the cushions may be provided in various sizes, for example, extra-small, small, medium, large, and extra-large, to accommodate the various sizes and shapes of individuals. In some such embodiments, as the support devices increase in size, the size of the cushions may change, the relative location of the deformity within the cushion may change, and the size and shape of the deformity may change.

Figure 10:
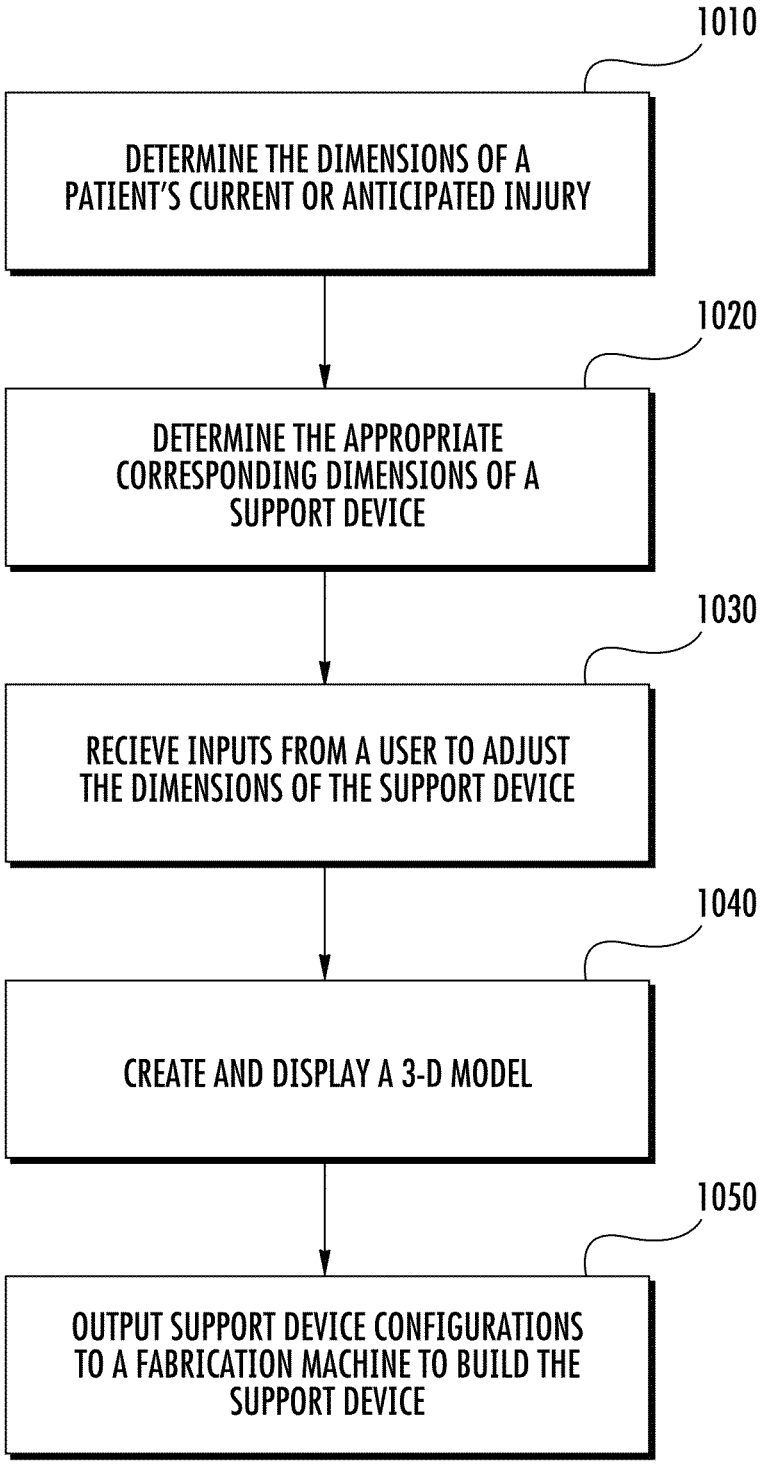
FIG. 10 depicts one embodiment of a method of manufacturing a support device.

In some embodiments, the device is patient-specific, molded to have a fully-deployed size and shape which conforms to the contours and dimensions of a particular patient. For example, in some embodiments, the support device is formed for a particular patient with the aid of a computer and modeling software. As shown in FIG. 10, in some embodiments, the dimensions of a patient's site of injury are measured, as indicated at block 1010. Such dimensions may include, for example, the length, width, depth, and/or angle of curvature of an injured body portion. The width, depth, and/or angle of curvature measurements may be taken at a plurality of locations along the length of the injured site. In some embodiments, said body dimensions are not the dimensions of a current injury site, but rather, are the expected post-operative dimensions of a surgically-altered body portion in a patient planning to undergo an augmentation procedure or the expected dimensions of one or more other post-operative surgical sites. In some embodiments, the expected dimensions are mapped out by a healthcare provider using modeling/simulation software, for example, during augmentation planning. These body dimensions are then used as an input in a computer running modeling software, and as shown at block 1020, the computer executes a series of steps to calculate corresponding appropriate dimensions for a support device. Every dimension of the support device may be personally tailored, for example, the size and shape of the deformity, the desired material properties of the deformity, the desired material properties of the walls, the curvatures of the walls, and the width, depth, and length of the cushions, etc. In some embodiments, the dimensions of the support device are specifically selected such that the cushions of the support device fit snuggly around the injured site and the injured site can be disposed substantially or entirely on or in the deformity. In some embodiments, for example, at optional block 1030, a patient, physician, or other user of the system may adjust the dimensions of the desired support device. In some embodiments, for example, at optional block 1040, the computer may generate a 3-D model of the injured site and/or the support device during the development process. At block 1050, the appropriate or desired dimensions and specifications of the support device are sent as instructions to a fabrication machine to build the support device according to said dimensions and specifications. In some embodiments, the fabrication machine is a 3-D printer, a plastic extrusion and/or welding machine, or other automated or semi-automated machine configured to manufacture the support device.

Support devices, such as any of the embodiments of support devices described herein, may be used to improve the recovery process for an individual during surgery, healing from surgery, or recovering from other trauma or injury. In use, the support devices can be used to distribute a patient's weight away from the site of injury, thereby limiting the application of pressure to the injured site. Such a device can be extremely advantageous when used after cosmetic or reconstructive surgery, such as an augmentation procedure. As described above, the application of pressure to a site of tissue augmentation may cause displacement of injected fat, leading to flattening or other undesirable reshaping; the pressure may also cause reabsorption of the injected fat, reducing the size of a patient's augmented body part. Thus, various embodiments of the support device described herein may be used to limit such reconfiguration of recently augmented tissue, by expanding the device, if expandable and not yet expanded, and positioning the fully-deployed device on or under a patient recovering from an augmentation procedure. In various embodiments, the device is positioned on or under the body so that the augmented body portion is disposed substantially or entirely over or within a cavity or depression of the device. In such a position, all or substantially all of the augmented body portion is free from contact with any surface. Thus, when the patient places his or her bodyweight on the device, the pressure from the weight will be distributed to the portions of the body that are in contact with the device. Similarly, in other embodiments, the device is positioned on or under the body so that the augmented body portion is disposed substantially or entirely on top of a deformity of the device. The deformity of various embodiments is flexible and readily deforms under the augmented body portion providing little to no resistance or support. In this manner, the patient avoids placing pressure sufficient to cause undesired reconfiguration of the augmented tissue on the body at the augmented site.

In some embodiments, the amount of shear force exerted on the skin, muscles, and fat located at the augmented site is reduced relative to the amount of shear force exerted when a standard support structure (e.g., a chair or mattress) is used alone. In some such embodiments, little to no shear force is exerted on the skin, muscles, and fat located at the augmented site. In some embodiments, the patient is able to avoid placing any pressure on the body at the augmented site. In other embodiments, the application of pressure on the body at the augmented site is restricted so that it is limited, for example, to a maximum of 20 kPa, a maximum of 5 kPa, or a maximum there between. In some embodiments, the application of pressure on the body at the augmented site is reduced, for example, by at least 25%, 50%, or 75% relative to the amount of pressure applied when a standard support structure (e.g., a chair or mattress) is used alone. In various embodiments, the pressure is instead applied to areas adjacent and/or remote to the augmented site. In some embodiments, the device is used for 2-4 weeks following augmentation surgery, and optionally, up to 6 weeks, 2 months, 3 months, or even 6 months following the surgery.

In some embodiments, positioning the device on or under the body involves sitting a body down on the device or laying a body down on the device. In some embodiments, the method of limiting the application of pressure to an augmented site further includes selecting a device with a proper size and configuration, such as, for example, any of the sizes and configurations described elsewhere herein. For example, the size and location of the deformity may vary based on the size of the patient and the location of the augmentation. Additionally, the configuration of the device may vary based on whether the patient wishes to use the device to support him or her while sitting or lying down.

Similarly, in other embodiments, a support device embodiment described herein may be used to limit pressure application to any injured site, by expanding the device, if expandable and not yet expanded, and positioning the fully-deployed device on or under a patient having an injury. In various embodiments, the device is positioned on or under the body so that the injured body portion is disposed substantially or entirely over or within a cavity or depression of the device and all or substantially all of the injured body portion is free from contact with any surface. When the patient places his or her bodyweight on the device, the pressure from the weight will be distributed to the portions of the body that are in contact with the device. In other embodiments, the device is positioned on or under the body so that the injured body portion is disposed substantially or entirely on top of a deformity of the device. The deformity of various embodiments is flexible and readily deforms under the injured body portion providing little to no resistance or support. In some embodiments, such as embodiments including a phase transition gel, the deformity is formed under the injured body portion by placing the injured body portion onto the support device with a radiofrequency transmitter disposed on a bandage covering or surrounding the injured body portion. In various embodiments, the patient avoids placing pressure sufficient to cause pain or damage to the injured body portion.

In some embodiments, the amount of shear force exerted on the skin, muscles, and fat located at the injured site is reduced relative to the amount of shear force exerted when a standard support structure (e.g., a chair or mattress) is used alone. In some such embodiments, little to no shear force is exerted on the skin, muscles, and fat located at the injured site. Thus, painful stretching of the skin, muscles, or fat tissue at the injured site is avoided. In some embodiments, the patient is able to avoid placing any pressure on the body at the injured site. In other embodiments, the application of pressure on the body at the injured site is restricted so that it is limited, for example, to a maximum of 20 kPa, a maximum of 5 kPa, or a maximum there between. In some embodiments, the application of pressure on the body at the injured site is reduced, for example, by at least 25%, 50%, or 75% relative to the amount of pressure applied when a standard support structure (e.g., a chair or mattress) is used alone. In various embodiments, the pressure is instead applied to areas adjacent to and/or remote to the injury.

In some embodiments, positioning the device on or under the body involves sitting a body down on the device or laying a body down on the device. In some embodiments, the method of limiting the application of pressure to an injury further includes selecting a device with a proper size and configuration. For example, the size and location of the deformity may vary based on the size of the patient and the location of the injury. Additionally, the configuration of the device may vary based on whether the patient wishes to use the device to support him or her while sitting or lying down.

The methods disclosed herein comprise one or more steps or actions for achieving the described method. The method steps and/or actions may be interchanged with one another without departing from the scope of the claims. In other words, unless a specific order of steps or actions is specified, it is contemplated that the order and/or use of specific steps and/or actions may be modified.

Those of skill in the art will appreciate that the various illustrative logical blocks described in connection with certain embodiments disclosed herein, such as, for example, embodiments for manufacturing a patient-specific support device, may be implemented as electronic hardware, computer software, or combinations of both. To clearly illustrate this interchangeability of hardware and software, various illustrative components and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the disclosure.

The various illustrative logical blocks described in connection with certain embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

In one or more example embodiments, the functions described may be implemented in hardware, software, or firmware executed on a processor, or any combination thereof. For example, certain embodiments may comprise a computer program product for performing the operations presented herein. Such a computer program product may comprise a computer readable medium having instructions stored and/or encoded thereon, the instructions being executable by one or more processors to perform the operations described herein. When the functions and methods described herein are implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium.

Further, it should be appreciated that modules and/or other appropriate means for performing the methods described herein can be downloaded and/or otherwise obtained by a device as applicable. For example, such a device can be coupled to a server to facilitate the transfer of means for performing the methods described herein. Alternatively, various methods described herein can be provided via storage means (e.g., RAM, ROM, a physical storage medium such as a compact disc (CD) or flash drive, etc.), such that a device can obtain the various methods upon coupling or providing the storage means to the device. Any other suitable technique for providing the methods and techniques described herein to a device can be utilized.

Although the foregoing has included detailed descriptions of some embodiments by way of illustration and example, it will be readily apparent to those of ordinary skill in the art in light of the teachings of these embodiments that numerous changes and modifications may be made without departing from the spirit or scope of the appended claims.

What is claimed is:

1. A method for limiting reconfiguration of fat tissue that has been surgically placed and shaped into a patient's buttocks, said method comprising:

providing a shape-memory support device comprising at least a portion which is expandable, wherein, when expanded, said device is shaped to define a deformity that restricts application, onto said fat tissue, of a pressure sufficient to cause undesired reconfiguration of said fat tissue; and following buttocks augmentation surgery, while said patient is recovering from said buttocks augmentation surgery, positioning said device in an expanded configuration under said patient for one or more periods of anticipated pressure application, wherein said device is aligned under said patient such that said buttocks is placed fully within said deformity with all of said surgically placed fat tissue disposed within said deformity and raised above any surface below said device in order to restrict the application of said pressure on said fat tissue.

2. The method of claim 1, further comprising expanding said device.

3. The method of claim 1, wherein said tissue has been placed and shaped in the patient's body within the past six months.

4. A method of manufacturing a shape-memory support device for limiting reconfiguration of cosmetically augmented tissue in a portion of a patient's body, said method comprising:

identifying one or more expected reconfigured dimensions of said body portion, wherein said expected reconfigured dimensions comprise planned dimensions for an augmented buttocks following surgical placement and shaping of fat tissue into a buttocks of said patient; and forming said device, wherein at least a portion of said device is expandable, and wherein an expanded device shape is selected based, at least in part, on said expected reconfigured dimensions such that said device, when expanded, defines a deformity that complements the augmented buttocks and is sized to fully receive said surgically placed fat tissue within said deformity and elevate said surgically placed fat tissue above any surface below said device in order to restrict the application, onto said tissue, of a pressure sufficient to cause undesired reconfiguration of said tissue.

* * * * *